United States Patent [19]

Cox

[11] 4,050,685

[45] Sept. 27, 1977

[54] DISASSEMBLABLE SKI CLAMPING APPARATUS

[76] Inventor: Robert C. Cox, Eight Harold Court, Walnut Creek, Calif. 94598

[21] Appl. No.: 730,217

[22] Filed: Oct. 6, 1976

[51] Int. Cl.[2] ..... B25B 1/20

[52] U.S. Cl. ..... 269/296; 269/88; 269/321 W

[58] Field of Search ..... 269/43, 296, 88, 321 W

[56] References Cited

U.S. PATENT DOCUMENTS

| | | | |
|---|---|---|---|
| 2,312,914 | 3/1943 | Koszeghy | 269/296 |
| 3,778,048 | 12/1973 | Szohatsky | 269/43 |
| 3,977,663 | 8/1976 | Kohler et al. | 269/321 W |

FOREIGN PATENT DOCUMENTS

| | | | |
|---|---|---|---|
| 2,143,861 | 3/1972 | Germany | 269/321 W |

*Primary Examiner*—Harold D. Whitehead
*Assistant Examiner*—Robert C. Watson
*Attorney, Agent, or Firm*—C. Michael Zimmerman

[57] ABSTRACT

A portable ski clamping apparatus is described for rigidly supporting a ski for maintenance and repairs. The apparatus includes a base from which a ski is to be supported, a clamp projecting centrally from the base adapted to grip a ski by its side edges generally at the mid-portion of such ski, a pair of support standards projecting from the base on opposite sides of the clamp to be engaged by a ski gripped by the clamp, and means for reducing the distance of the clamp from the base relative to the distance therefrom at which the support standards engage the ski to thereby urge the ski against such support standards for lateral support at the locations of such standards. The standards define open-mouthed slots which are generally parallel to one another for simultaneous receipt of a ski on edge at spaced-apart locations. Each of such standards is mounted on the base for rotation about an axis extending through the bottom and mouth of its slot, and means are provided for maintaining each of said standards in a selected position of rotation in which the opposed sides of the slot frictionally engage any ski in such slot to grip such ski. Thus, the clamp cooperates with the standards for firmly supporting a ski with either its top or bottom surfaces facing upwardly, and the slots in the standards provide firm support of the ski with either of its edges facing upwardly to be worked on.

12 Claims, 4 Drawing Figures

DISASSEMBLABLE SKI CLAMPING APPARATUS

BACKGROUND OF THE INVENTION

The present invention relates to apparatus for rigidly supporting a ski during work thereon and, more particularly, to such an apparatus utilizing ski gripping principles providing the desired film support of the ski while enabling such apparatus to be quite light and easily disassemblable for compact carrying and storage.

In recent years, snow skiing has become one of the major winter recreational activities. As the number of proficient skiers has increased, a demand has grown for a compact portable ski clamping arrangement that a skier can set up at a ski location to do minor repair or improvements to his skis. For example, often the edges of skis need to be sharpened or the bottom of the skis treated for optimum speed and control. While at most ski facilities there are commercial ski shops available to perform this work, it is generally expensive to have it done professionally, and one can often expect a long wait for his skis. Thus, the need has arisen for a portable and inexpensive apparatus a skier can easily carry to a ski location for holding his skis when he wishes to do minor work thereon. While so-called "portable" ski work benches have been designed in the past, e.g., the bench described in U.S. Pat. No. 3,826,482, they have left much to be desired. For one thing, most available have relied on a vise to provide the actual support of the ski, which vise must be firmly and rigidly supported in position to operate properly. This has resulted in the supporting structure for the vise being relatively heavy and complicated.

SUMMARY OF THE INVENTION

The present invention provides an apparatus for supporting a ski which relies on principles taking advantage of a ski's geometry to provide rigid support of the same without requiring a relatively heavy vise or the like. In order to provide support of a ski with either its upper surface or bottom facing upwardly, the apparatus includes, in its basic aspects, a clamp extending from a base adapted to grip a ski to be supported at its midportion; a pair of support standards extending from the base on opposite sides of the clamp and spaced therefrom to engage the ski at locations spaced from such clamp; and means for reducing the distance of the clamp from the base relative to the distance therefrom at which the support standards engage the ski, to thereby urge the ski against such support standards. The support standards provide lateral support for the ski to prevent the same from rotating relative to the base. Thus the clamp itself need not be secured to the base with rigid heavy structure, i.e., the mounting structure for the clamp need not provide lateral structural support.

It should be noted that skis are flexible somewhat in the direction in which the clamp of the apparatus is moved. As another salient feature of the instant invention, a material having a high coefficient of friction, such as rubber, is provided at the surface of each of the support standards engaged by the ski when the distance of the clamp from the base is reduced. Because the ski flexes, it is resiliently urged against such high coefficient of friction material to provide quite good engagement at said standards to prevent unwanted ski movement thereat.

Other components of the apparatus are relied on to support the ski with either of its edges facing upward.

To this end, in its basic aspects, the apparatus includes a pair of spaced apart bracket standards extending from the base defining spaced slots extending generally parallel to one another for simultaneous receipt of the ski. Each of the bracket standards is mounted on the base for rotation about the axis of its slot, and means are provided for maintaining each of such standards in a selected position of rotation in which opposed sides of the slot therein frictionally engage any ski in such slot to grip the ski at the slot's location. Most desirably and simply, the standards having the spaced slots are the very same standards which engage the ski to prevent it from rotating when either its upper or bottom surfaces faces upwardly. Moreover, a material which is resilient and has a high coefficient of friction, such as rubber, defines the opposed slot sides both to protect the surfaces of a ski therein and to enhance the frictional engagement of the slot therewith.

It will be recognized from the above that the principles utilized in the invention to rigidly support a ski rely primarily on the counteracting of one force applied to the ski with another, e.g., the downward force of a ski provided by the clamp is opposed by the upward force exerted by the standards, and the turning moment exerted on a ski in a slot when its associated standard is rotated is opposed by the other standard. These counteracting force arrangements do not rely on the securance of the apparatus firmly to a support structure, such as to a table. Also, they are provided solely by the clamp and standards enabling the base of the structure to be simplified with the result that it can be made easily disassemblable without tools for compact carrying and storage.

The apparatus of the invention includes other features which will be described or will become apparent from the following more detailed description of a preferred embodiment.

BRIEF DESCRIPTION OF THE DRAWING

With reference to the accompanying three sheets of drawing.

DETAILED DESCRIPTION OF A PREFERRED EMBODIMENT

Figure 1:
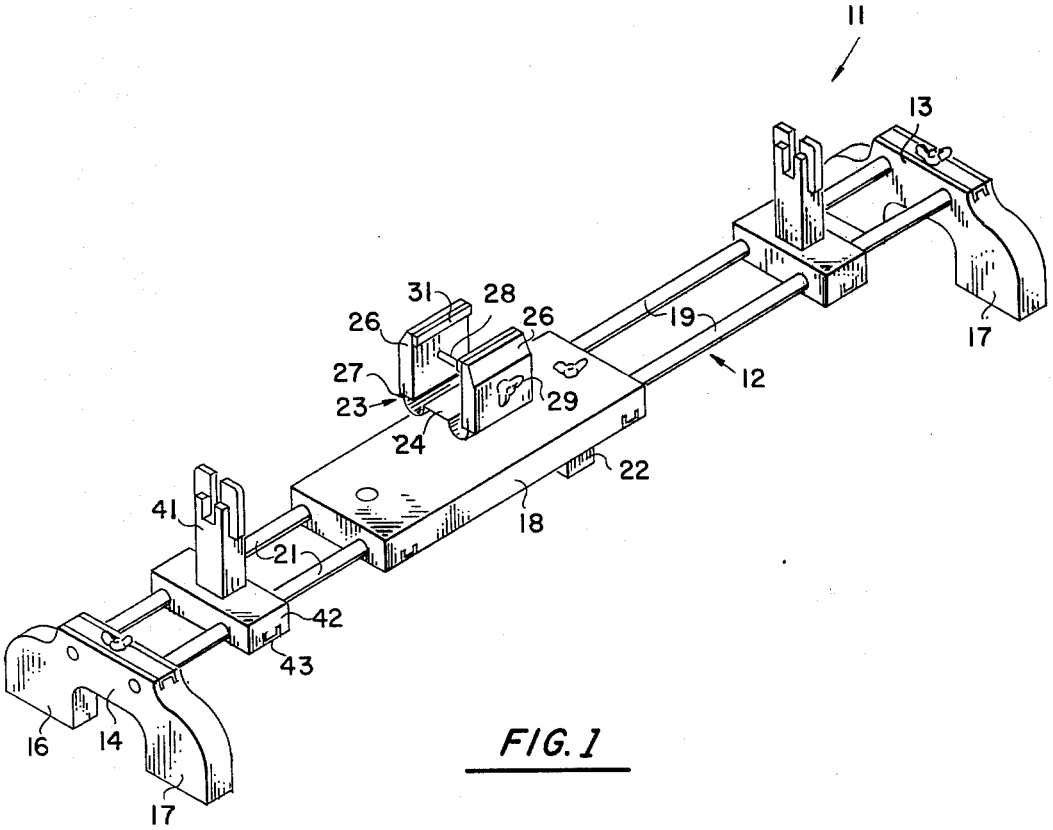
FIG. 1 is an overall, broken isometric view of a preferred embodiment of the apparatus of the invention.

With reference to the accompanying drawings, the ski supporting apparatus of the invention, generally referred to by the reference numeral 11, includes a base made up of an elongated mounting structure 12 having leg supports 13 and 14 at its opposite ends. Each of the leg supports 13 and 14 includes a pair of legs 16 and 17 for supporting the apparatus on a work surface, such as on a table.

Mounting structure 12 is the operable part of the base on which the ski engaging support structures are mounted. In this connection, such mounting structure 12 includes a plate platform 18 at its center having projecting respectively from each end thereof, pairs 19 and 21 of track rails. Such pairs 19 and 21 of rails extend from the plate platform 18 to the respective leg structures 13 and 14, and define a track therebetween as will be described. A foot 22 depends downwardly from platform 18 for engagement with a support surface to provide support for the center of the mounting structure.

Platform 18 has a clamp 23 extending upwardly from its upper surface. Such clamp includes a base 24 separating a pair of opposed jaws 26. Base 24 is spring steel and is connected with the jaws 26 via spring steel connecting plate portions 27. Connecting plates 27 act not only as hinges, but also resiliently urge the jaws 26 away from one another or, in other words, urge the clamp into an open position.

Means are provided for drawing the jaws 26 toward one another to clamp a ski therebetween. That is, a bolt 28 extends through and between the jaws 26 at a location spaced above the base 24, which bolt is provided with a wing nut 29 on its threaded end. It will be recognized that one can draw the jaws 26 toward one another to grip a ski, or allow the same to retract from one another by appropriately rotating the wing nut 29 on the bolt 28. Because the hinge connection between the jaws 26 and the base 24 are provided by spring steel connecting plates 27, unthreading of the wing nut 29 will cause the jaws to automatically separate from one another due to the resilient urging provided by such connecting plates.

The lip of each of the jaws 26 which engages a ski is padded to prevent the same from marring the surface of such ski. To this end, the opposed upper lips of the jaws 26 are covered by rubber pads 31. Clamp 23 is mounted on the base by means permitting the distance of such clamp from such base to be reduced. More particularly, a bolt or pin 32 extending downwardly from such clamp passes through a hole 23 projecting through the platform 18 at its center. A wing nut 34 threadably engages the free end of the bolt 32 underneath the platform 18, and a coil spring 36 axially surrounds the bolt 32 and is maintained in tension between the clamp and platform 18 to normally urge such clamp upward and away from the platform. With this construction, it will be recognized that the distance of the clamp from the base can be adjusted merely by rotating the wing nut 34 on the pin 32 to either pull the clamp toward the platform or allow spring 36 to move the clamp away from such platform.

The apparatus further includes a pair of standard structures 37 and 38 extending from the base in generally the same direction from which the clamp extends therefrom, on opposite sides of such clamp and spaced therefrom. Each of such standards includes an intermediate upright 41 extending upwardly from a base plate 42. The underneath surface of each base plate 42 is, in turn, slidably mounted on its associated pair of track rails by receiving said rails in bores which extend therethrough. The opposed sides of a channel lock 43 extend into slots 44 in the base plate traversing the bores which extend therethrough. Each channel lock 43 is secured to its associated support base plate via a bolt or threaded pin 45 which depends downwardly from the base through an aperture 46 in the channel lock. A wing nut 47 is threadably received on the free end of the pin 44 to secure the structure together with the track rails clamped therebetween.

The upright 41 of each of the standard stuctures 37 and 38 supports a bracket 48 which provides the actual engagement of the standard with a ski. In this connection, the upper edge surface of each bracket 48 most desirably is both resilient and has a high coefficient of friction. To this end, the bracket 48 is covered with a material 49 such as soft rubber having these properties. Each of the brackets 48 is also provided with an open-mouthed slot facing upwardly, with its mouth at the upper surface of such bracket. The opposed sides of each of the slots 51 is then also defined by a material which is both resilient and has a high coefficient of friction. The slots 51 are sized to receive a ski oriented with its side edges maintained horizontal with a vertical spacing therebetween and support the ski in such position.

Standards 37 and 38 cooperate with the clamp 23 to rigidly support a ski oriented with either its binding or bottom surfaces facing upwardly for work access. When it is desirable to so support a ski, the clamp is made to grip the same with its jaws 26 in the manner previously discussed. It will be recognized, however, that the clamp alone cannot provide rigid support of a ski. Such clamp is connected to the base structure only by the pin 32, with the result that a ski generally could be rotated with the clamp about such pin if the clamp was the sole component of the invention providing ski support.

Figure 2:
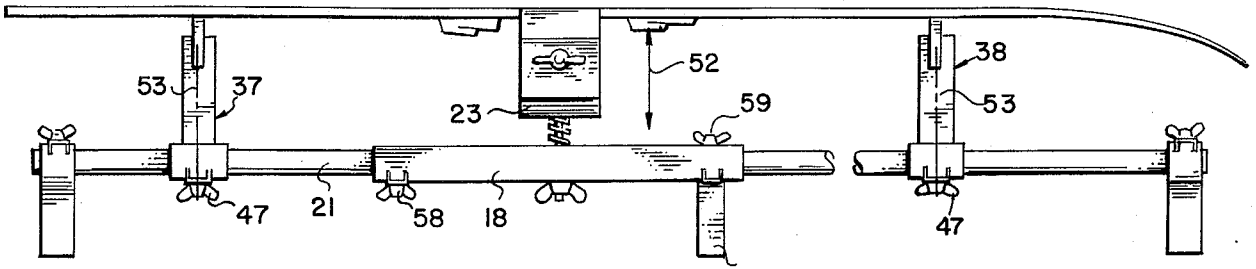
FIG. 2 is a broken side elevation view illustrating the apparatus of the invention rigidly supporting a ski with its bottom surface facing upwardly.

The support standards 37 and 38 cooperate with the clamp to provide the desired rigid support in a simple manner eliminating the necessity of more complicated and heavy structure connecting the clamp to the base. Such suport is schematically illustrated in FIG. 2 in which the clamp is shown gripping a ski having its binding surface facing upwardly. As illustrated, the clamp has been retracted downward toward the base of the apparatus to reduce its distance therefrom. Arrow 52 is included in FIG. 2 to indicate the direction of such movement.

Reduction of the distance of the clamp from the base will urge the ski ends against the upper surfaces of the standards 37 and 38. Because the ski is made to be flexible in the same direction in which the distance of the clamp from the base is reduced, the ski will be resiliently urged against the support standards. The resulting frictional engagement of the ski with the standards will provide lateral support of such ski at the locations at which it is engaged by such standards. This lateral support is enhanced appreciably by the material 49 covering the upper edge surface of each bracket. That is, because the material is both resilient and has a high coefficient of friction, it will increase the frictional engagement between the ski and the standard to assure that the ski will not move relative to the apparatus when forces are applied to it during work thereon.

The standards 37 and 38 alone provide support for a ski when it is desired to maintain it in an orientation normal to the orientation illustrated in FIG. 2, i.e., with either of its edges facing upwardly. More particularly, with reference to FIG. 3, a ski is placed simultaneously in both of the slots 51 with its mid-portion passing unhindered between the jaws of the clamp 23, i.e., the clamp 23 is not actuated to grip the ski.

Figure 3:
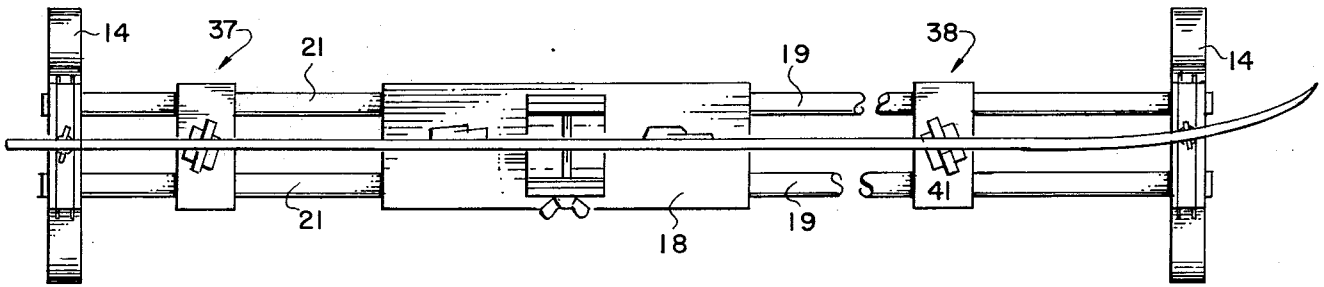
FIG. 3 is a broken plan view illustrating the apparatus of the invention rigidly supporting a ski with one of its side edges facing upwardly.

Each of the standards 37 and 38 is mounted on the base for rotation about the axis of its slot 51, i.e., about an axis which passes both through the bottom of the slot and its mouth. That is, the bolt 45 is rigidly secured to the intermediate upright 41 of each of the standards, but passes rotatably through the base plate 42 thereof. The intermediate upright 41 and the bracket 48 supported thereby is thus rotatable with the bolt relative to the base plate. The axis of the bolt 45 is the axis of such rotation, and the bolt 45 is installed in the upright 41 to be aligned with the slot 51. FIG. 2 illustrates this relative positioning of the bolt 45 with the slots via a center line representation at 53. Thus, to grip a ski with a standard, it is only necessary to rotate the standards so that the opposed sides of the slot therein frictionally engage the ski. FIG. 3 illustrates both of the standards so rotated.

In order to maintain their grip on a ski, it is necessary that the bracket standards be held in any selected position of rotation. The wing nut 47 on the end of each of the bolts 45 acts as means for maintaining each of such standards in such a selected position. That is, when the wing nut 47 is tightened on its associated bolt 45, the upright 41 is forced against the upper surface of the base plate 42 and frictionally held in any position in which it finds itself. Thus, the grip of each of the standards on the ski at the standard's location can be maintained during the time it is desired that a ski be firmly held with one of its edges facing upwardly. The rubber material 49 defining the opposed side edges of the slot in each standard enhances the grip, similarly to the enhancement provided by the rubber on the upper surface of such standard. Moreover, such rubber shields the finish of the ski from being marred by the bracket standards.

It should be noted that for versatility, the relative positions of the bracket standards 37 and 38 are adjustable. One reason for such an adjustment being made would be to accommodate skis of differing lengths. To enable such adjustment, the standards are slidably mounted toward and away from one another on the rails 19 and 21. Tightening of the wing nut 47 performs the dual function of maintaining the upright 41 of its associated support structure in a selected position of rotation, and maintaining the full support structure in a selected location along the length of its associated track rails by forcing the sides of the channel lock 43 into frictional engagement with such track rails.

Figure 4:
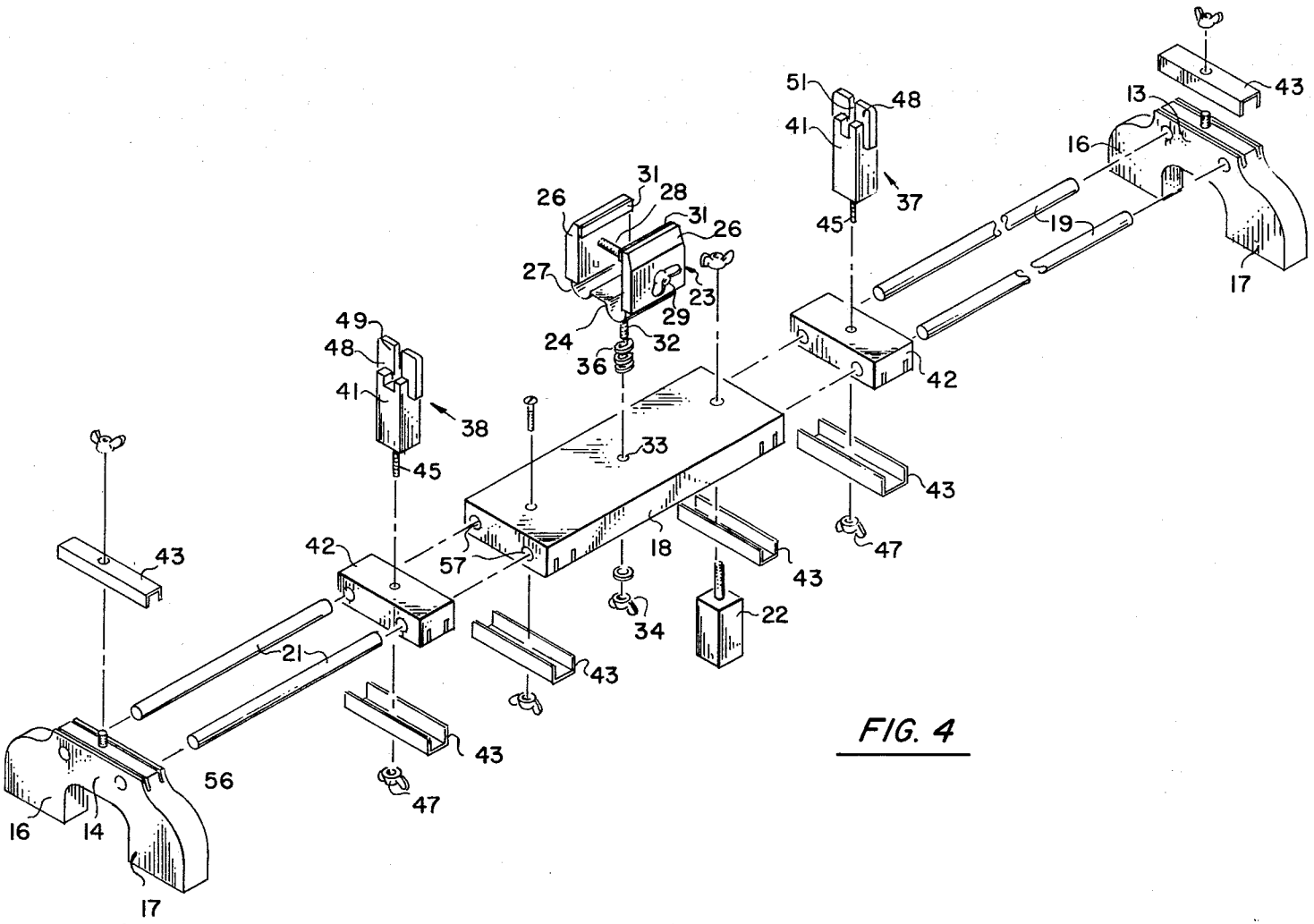
FIG. 4 is an exploded isometric view illustrating the manner in which the apparatus is disassemblable.

Because the apparatus of the invention provides rigid support of a ski without requiring relatively heavy or complicated structures, it can be made into components which can be easily disassembled from one another. This aspect of the apparatus is especially advantageous since it facilitates its transportation to a ski location by an individual skier for use, and its storage when not in use. FIG. 4 illustrates the apparatus disassembled into its various components. It should be noted that each of the leg structures 13 and 14 is simply removable from its associated pair of track rails. That is, the ends of each pair of track rails associated with a leg structure is secured to such leg structure by a channel lock 56. Loosening of the channel lock 56 enables such track rails to be extracted from the leg structures. The other ends of the track rails fit within bores projecting inwardly of their associated end of the center plate 18 and channel locks 56 are provided traversing the bores at each end of the center plate 18. The leg 22 is secured to the center plate 18 by a bolt and wing nut combination 59 which also secures the channel lock 57 at its end of the center plate to such center plate. The clamp 23 and the support standards 37 and 38 are simply removable from the remainder of the structure by loosening the wing nuts 34 and 47, respectively.

It will be seen from the above that because of the simplicity of the apparatus, it is an easy task for one to disassemble and reassemble the apparatus as desired.

The invention has been described in connection with a preferred embodiment thereof. It will be appreciated by those skilled in the art that various changes and modifications can be made, however, without departing from its spirit. For example, although the support standards 37 and 38 provide a dual function, i.e., cooperate with the clamp to provide rigid support of a ski when it is in its flexing direction as well as provide slots which support a ski on edge, these functions could be provided by separate sets of standards. It is therefore intended that the coverage afforded applicant be limited only by the claims and their equivalent language.

I claim:

1. Apparatus for firmly supporting a ski during work thereon, comprising a base including an elongated mounting structure from which said ski is to be supported; a clamp projecting from said mounting structure adapted to grip a ski to be supported generally at the midportion thereof; a pair of support standards projecting from said mounting structure in generally the same direction from which said clamp extends therefrom and on opposite sides of said clamp and spaced therefrom to engage said ski at locations spaced from said clamp; and legs at opposite ends of said mounting structure depending therefrom for supporting the same on a work surface; and means for reducing the distance of said clamp from said base relative to the distance therefrom at which said support standards engage said ski to urge said ski against said support standards for lateral support thereof at said locations; said clamp and said support standards each being selectively demountable from said base, said legs being selectively removable from said mounting structure, and said base including said mounting structure being disassemblable into shorter lengths to permit said apparatus to be disassembled for compact carrying and storage when not in use supporting a ski.

2. Apparatus for firmly supporting a ski during work thereon comprising a base from which said ski is to be supported; a clamp extending from said base adapted to grip a ski to be supported generally at the midportion thereof, said clamp being adapted to grip said ski on opposed side edges generally adjacent the center of said ski; a pair of support standards projecting from said base in generally the same direction from which said clamp extends therefrom and on opposite sides of said clamp and spaced therefrom to engage said ski at locations spaced from said clamp; a high coefficient of friction material at the surface of each of said support standards engaged by said ski; and means for reducing the distance of said clamp from said base relative to the distance therefrom at which said support standards engage said ski to urge said ski adjacent said support standards for lateral support thereof at said location, said means reducing said distance in a direction in which said ski flexes to resiliently urge said ski against said high coefficient of friction material on said support structures.

3. Apparatus according to claim 2 for firmly supporting a ski during work thereon further including means separate and apart from said clamp for supporting a ski from said base when said ski is in an orientation rotated axially and generally normal to the orientation at which said clamp supports said ski.

4. Apparatus according to claim 3 for firmly supporting a ski during work thereon wherein said means for firmly supporting the ski in an orientation generally normal to the orientation in which said ski is engaged and supported by said clamp includes a pair of spaced-apart bracket standards extending from said base on opposite sides of said clamp in generally the same direction, each of said standards defining an open-mouthed slot which is generally parallel to the open-mouthed slot of the other for receipt of said ski in said standards simultaneously at spaced-apart locations; means mounting each of said standards for rotation about an axis extending through the bottom and mouth of said slot; and means for maintaining each of said standards in a selected position of rotation in which the opposed sides of the slot therein frictionally engage any ski in said slot to grip said ski thereat.

5. Apparatus according to claim 4 for firmly supporting a ski during work thereon wherein each of said support standards which cooperate with said clamp for firmly supporting a ski in its flexing direction also defines one of said open-mouthed slots, whereby said standards function not only to support said ski when it is in said flexing direction, but also when it is in said direction normal thereto.

6. Apparatus for firmly supporting a ski during work thereon, comprising a base from which said ski is to be supported; a pair of spaced-apart bracket standards extending from said base in generally the same direction defining spaced slots extending generally parallel to one another for simultaneous receipt of said ski, each of said bracket standards being mounted on said base for rotation on the axis of the slot defined thereby which passes both through the bottom and mouth of said slot; and means for maintaining each of said standards in a selected position of rotation in which the opposed sides of the slot therein frictionally engage any ski in said slot to grip said ski thereat.

7. Apparatus according to claim 6 for firmly supporting a ski during work thereon further including a resilient material having a high coefficient of friction defining the opposed sides of each of said slots to provide said frictional engagement of any ski in said slot.

8. Apparatus according to claim 6 for firmly supporting a ski during work thereon further including means for rigidly supporting a ski from said base when said ski is axially rotated to an orientation generally normal to the orientation in which said ski is supported when it is in said slots in said standards.

9. Apparatus for firmly supporting a ski during work thereon, comprising a base from which said ski is to be supported; a pair of spaced-apart bracket standards extending from said base in generally the same direction defining spaced slots extending generally parallel to one another for simultaneous receipt of said ski, each of said bracket standards being mounted on said base for rotation about the axis of the slot defined thereby; means for maintaining each of said standards in a selected position of rotation in which the opposite sides of the slot therein frictionally engage any ski in said slot to grip said ski thereat; and means for rigidly supporting a ski from said base when said ski is axially rotated to an orientation generally normal to the orientation in which said ski is supported when it is in said slots in said standards, said latter means comprising a clamp extending from said base adapted to grip a ski, a pair of support standards extending from said base in generally the same direction from which said clamp extends therefrom and on opposite sides of said clamp and spaced therefrom to engage said ski at locations spaced from said clamp, and means for reducing the distance of said clamp from said base relative to the distance therefrom at which said support standards engage said ski to urge said ski against said support standards for lateral support thereof at said locations.

10. Apparatus according to claim 9 for firmly supporting a ski during work thereon wherein each of said support standards which cooperates with said clamp for rigidly supporting a ski from said base when said ski is in said normal direction also defines one of said slots whereby said standard functions to support said ski in both of said directions; each of said slots is an open-mouthed slot opening to the surface of its associated standard engaged by said ski when said ski is gripped by said clamp; and a resilient material having a high coefficient of friction is provided both at said surface of each of said support standards engaged by said ski and at the opposed sides of each of said slots to provide said frictional engagement with any ski in said slot.

11. Apparatus according to claim 6 for firmly supporting a ski during work thereon wherein said base includes a track on which said pair of spaced-apart bracket standards are slidably mounted toward and away from one another to enable adjustment of the locations at which said brackets engage a ski to be held thereby.

12. Apparatus according to claim 11 for firmly supporting a ski during work thereon wherein said means mounting each of said bracket standards for rotation about the axis of the slot defined thereby includes a pin extending coextensive with said axis, and said means for maintaining each of said standards in a selected position of rotation in which the opposed sides of the slot therein frictionally engages a ski in said slot to grip said ski thereat includes a wing nut threadably engageable with said pin to tighten said standard against said track and maintain said pin in an axial orientation thereof relative to said track.

* * * * *